US005931126A

United States Patent [19]

Eguchi et al.

[11] Patent Number: 5,931,126

[45] **Date of Patent: *Aug. 3, 1999**

[54] VALVE TIMING CONTROL DEVICE

[75] Inventors: Katsuhiko Eguchi; Atsushi Sato, both of Kariya, Japan

[73] Assignee: Aisin Seiki Kabushiki Kaisha, Aichi-Pref, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/758,856

[22] Filed: Dec. 2, 1996

[30] Foreign Application Priority Data

Nov. 30, 1995 [JP] Japan ..... 7-313390
Dec. 26, 1995 [JP] Japan ..... 7-339585

[51] Int. Cl.[6] ..... F01L 1/344

[52] U.S. Cl. ..... 123/90.17; 123/90.31; 123/90.34

[58] Field of Search ..... 123/90.15, 90.17, 123/90.31, 90.33, 90.34, 90.6; 74/567, 568 R; 464/1, 2, 160

[56] References Cited

U.S. PATENT DOCUMENTS

| | | | |
|---|---|---|---|
| 4,858,572 | 8/1989 | Shirai et al. | 123/90.12 |
| 4,991,549 | 2/1991 | Sugiura | 123/90.34 |
| 5,181,485 | 1/1993 | Hirose | 123/90.31 |
| 5,205,249 | 4/1993 | Markley et al. | 123/90.17 |
| 5,275,138 | 1/1994 | Hotta et al. | 123/90.17 |
| 5,450,825 | 9/1995 | Geyer et al. | 123/90.31 |

FOREIGN PATENT DOCUMENTS

| | | | |
|---|---|---|---|
| A-518528 | 12/1992 | European Pat. Off. . | |
| A-3937644 | 5/1991 | Germany . | |
| 4-209912 | 7/1992 | Japan | 123/90.17 |
| 5-113112 | 5/1993 | Japan | 123/90.17 |

*Primary Examiner*—Weilun Lo
*Attorney, Agent, or Firm*—Hazel & Thomas, P.C.

[57] ABSTRACT

A valve timing control device includes a rotor fixed on a cam shaft rotatably supported on a cylinder head of an engine so as to be accommodated in the cylinder head, a housing member rotatably mounted on the cam shaft so as to surround the rotor, plural chambers defined between the housing member and the rotor each of which having a pair of circumferentially opposed walls, plural vanes mounted on the rotor and extended outwardly therefrom in the radial direction into the chambers so as to divide each of chamber into a first pressure chamber and a second pressure chamber and a fluid supplying device for supplying fluid under pressure to at least a selected one of the first pressure chamber and the second pressure chamber.

4 Claims, 3 Drawing Sheets

VALVE TIMING CONTROL DEVICE

BACKGROUND OF THE INVENTION

1. Field of the Invention

The present invention relates to a valve timing control device and, in particular, to a valve timing control device for controlling an angular phase difference between a crank shaft and a cam shaft of a combustion engine.

2. Description of the Prior Art

In general, valve timing of a combustion engine is determined by valve mechanisms driven by a cam shaft according to a characteristic of the combustion engine or the use of the combustion engine. Since conditions of combustion are changed in response to the rotational speed of the combustion engine, it is difficult to obtain optimum valve timing through the whole rotational range. Therefore, a valve timing control device which is able to change valve timing in response to the condition of the combustion engine has, in recent years, been proposed as an auxiliary mechanism of the valve mechanism.

A conventional device of this kind is disclosed, for example, in U.S. Pat. No. 4,858,572. This device includes a rotor which is fixed on an outer projecting end of a cam shaft rotatably supported on a cylinder, a drive member which is driven by the rotational torque from a crank shaft and which is rotatably mounted on the outer projecting end of the cam shaft so as to surround the rotor, a plurality of chambers which are defined between the drive member and the rotor and each of which has a pair of circumferentially opposed walls and a plurality of vanes which are mounted to the rotor and which are extended outwardly therefrom in the radial direction into the chambers so as to divide each of chambers into a first pressure chamber and a second pressure chamber. In this device, a fluid under pressure is supplied to a predetermined one of either the first pressure chamber or the second pressure chamber in response to the running condition of the combustion engine and an angular phase difference between the crank shaft and the cam shaft is controlled so as to advance or retard the valve timing relative to the crank shaft. The valve timing control device is in the position of the maximum advanced condition when each of the vanes contacts with one of the opposed walls of each of the chambers. On the other hand, the valve timing control device is in the position of the maximum retarded condition when each of the vanes contacts with the other of the opposed walls of each of the chambers.

In the event that the valve timing control device is disposed at the outside of the cylinder head as in the above prior device, if the fluid, which is the same as a fluid for lubricating the engine, leaks from the chambers to outside, the amount of the fluid for operating the valve timing control device is decreased and other devices, which are located in the vicinity of the valve timing control device, become dirty. Therefore, strict fluid-tightness is required for the chambers, and additional seal members are always required for fluid-tight sealing of the chambers. Thereby, the structure of the valve timing control device is complicated.

SUMMARY OF THE INVENTION

It is, therefore, an object of the present invention to provide an improved valve timing control device which overcomes the aforementioned drawbacks.

It is another object of the present invention to provide an improved valve timing control device which has a simplified structure.

In order to achieve these objectives, there is provided an improved valve timing control device which includes a rotor fixed on a cam shaft rotatably supported on a cylinder head of an engine so as to be accommodated in the cylinder head, a housing member rotatably mounted on the cam shaft so as to surround the rotor, plural chambers defined between the housing member and the rotor, each of which having a pair of circumferentially opposed walls, plural vanes mounted on the rotor and extended outwardly therefrom in the radial direction into the chambers so as to divide each chamber into a first pressure chamber and a second pressure chamber and a fluid supplying means for supplying fluid under pressure to at least a selected one of the first pressure chamber and the second pressure chamber.

BRIEF DESCRIPTION OF THE DRAWINGS

Additional objects and advantages of the present invention will become more apparent from the following detailed description of a preferred embodiment thereof when considered with reference to the attached drawings, in which.

DESCRIPTION OF THE PREFERRED EMBODIMENTS

A valve timing control device in accordance with a preferred embodiment of the present invention will be described with reference to attached drawings.

Figure 1:
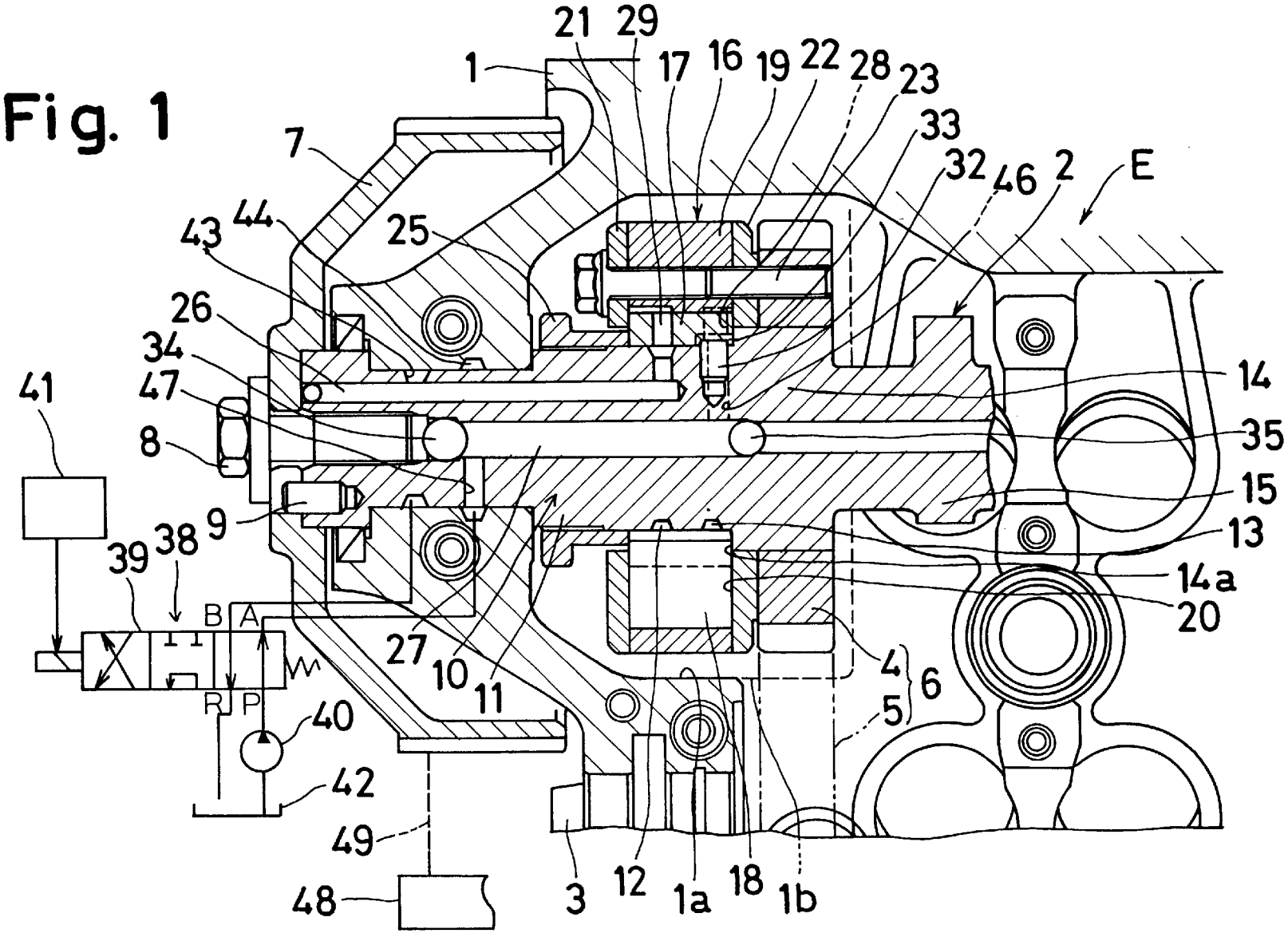
FIG. 1 shows a sectional view of an embodiment of a valve timing control device in accordance with the present invention.
Figure 2:
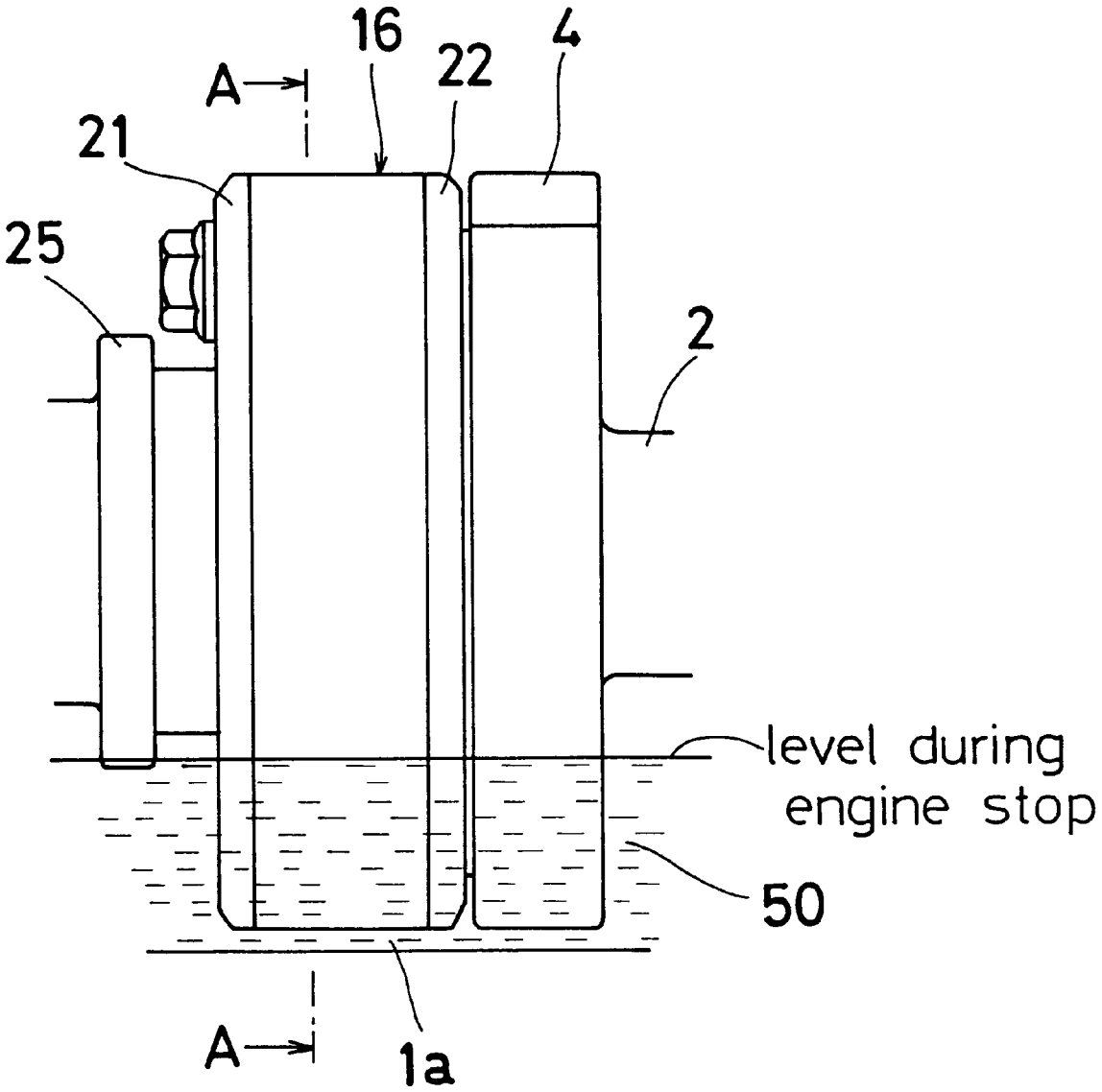
FIG. 2 shows a side view of an embodiment of a valve timing control device in accordance with the present invention.
Figure 3:
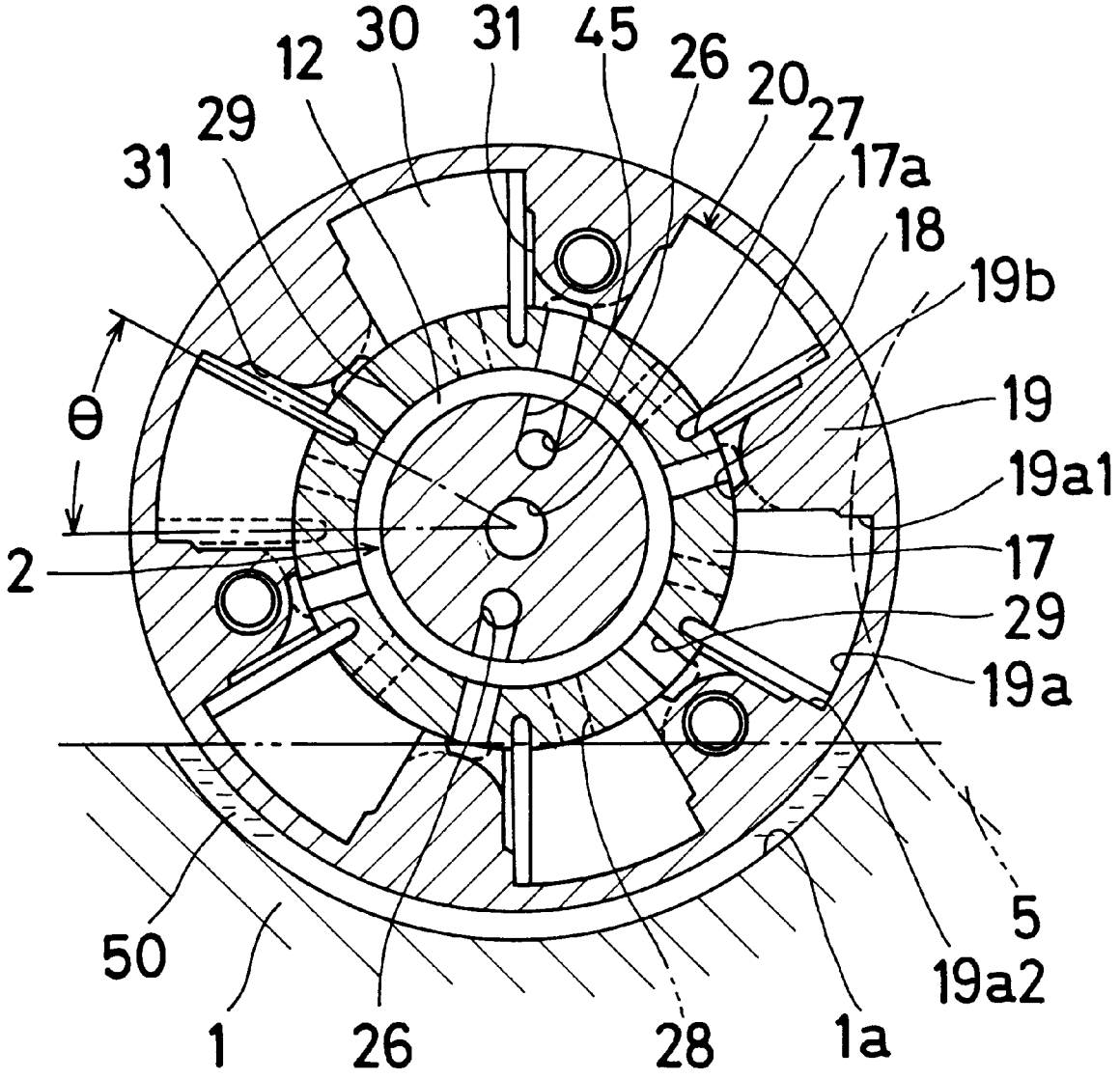
FIG. 3 shows a cross-sectional view taken on line A—A of FIG. 2.

In an embodiment shown in FIGS. 1 to 3, a valve timing control device according to the present invention is applied to an engine E of the DOHC (Double Over Head Cam Shaft) type.

Referring to FIG. 1, an exhaust cam shaft 2 (a cam shaft) and an intake cam shaft 3 (another cam shaft) are rotatably mounted on a cylinder head 1 of an engine and are connected to each other by a rotational torque transmitting means 6. The rotational torque transmitting means 6 is comprised of a gear 4 which is rotatably mounted on the exhaust cam shaft 2 and a gear 5 which is fixedly mounted on the intake cam shaft 3.

An end of the exhaust cam shaft 2 is projected out of the cylinder head 1 and a timing pulley 7 is fixed to this projecting end of the exhaust cam shaft 2 by a bolt 8. A stopper pin 9 is fixed to the projecting end of the exhaust cam shaft 2 and is fitted into a notch formed on the timing pulley 7 so that the relative rotation between the timing pulley 7 and the exhaust cam shaft 2 is prevented. Rotational torque is transmitted to the timing pulley 7 via a belt 49 from a crank shaft 48 which is rotated by the engine.

A cylindrical portion 10 of the exhaust cam shaft 2, which is extended into the cylinder head 1, is provided with a male screw portion 11 on which a male screw is formed and a passage portion on which two circular grooves 12, 13 are formed in order from a front side (left side) in FIG. 1. The circular grooves 12, 13 are formed so as to maintain a predetermined distance between each other in the axial direction. At the adjacent portion of the passage portion (at the right side of the passage portion in FIG. 1), a journal portion 14 having a larger diameter than that of the passage portion is formed and a plurality of cam portions 15 are continuously formed at the right side of the journal portion 14. On the journal portion 14, the gear 4 having three female screw holes which are penetrated in the axial direction and are separated in the circumferential direction at regular intervals is rotatably mounted thereon.

On the passage portion of the exhaust cam shaft 2, a valve timing control mechanism 16 is mounted thereon. As shown in FIG. 1 and FIG. 3, the valve timing control mechanism 16 includes a rotor 17, six vanes 18, a housing member 19, a circular front plate 21 and a circular rear plate 22. The rotor 17 has a cylindrical shape and is fixedly mounted on the passage portion of the exhaust cam shaft 2 by a pin 32. The pin 32 is pressed into the passage portion of the exhaust cam shaft 2 in the radial direction and is fitted into notch portion 33 formed on the inner circumferential portion of the rotor 17 so that the relative rotation between the rotor 17 and the exhaust cam shaft 2 is prevented. The housing member 19 has a cylindrical shape having an inner bore 19*b* and is rotatably mounted on the outer circumferential surface of the rotor 17 so as to surround the rotor 17. The housing member 19 has the same axial length as the rotor 17 and is provided with six grooves 19*a* which are outwardly extended from the inner bore 19*b* in the radial direction and which are separated in the circumferential direction at regular intervals. The housing member 19 is also provided with three holes which are penetrated in the axial direction and which are separated in the circumferential direction at regular intervals. The rear plate 22 is rotatably mounted on the journal portion 14 so as to be located between the gear 4 and one side face of the housing 19 and the rotor 17, and is provided with three holes which are penetrated in the axial direction and which are separated in the circumferential direction at regular intervals. The front plate 21 is located so as to be opposite to the other side face of the housing member 19 and the rotor 17 and is provided with three holes which are penetrated in the axial direction and which are separated in the circumferential direction at regular intervals. Three bolts 23 are fitted into the holes of the front plate 21, the housing member 19 and the rear plate 22, and are screwed into the female screw holes of the gear 4. Thereby, the front plate 21 is pressed fluid-tight to the other side face of the housing 19 and the rotor 17 and the rear plate 23 is fluid-tightly pressed to one side faces of the housing 19 and the rotor 17. Namely, the contacting portions among the front plate 21, the rotor 17 and the housing member 19 and among the rear plate 22, the rotor 17 and the housing member 19 are sealed by a metal contact, respectively.

One side face of the rotor 17 is contacted with a stepped portion 14*a* of the journal portion 14, and under this condition a nut 25 is screwed onto the male screw portion 11 of the exhaust cam shaft 2 so as to press the rotor 17 toward the journal portion 14. The valve timing control mechanism 16 is fixedly nipped between the journal portion 14 and the nut 25, such that rotor 17 is rotated with the exhaust cam shaft 2 as a unit.

Thereby, six chambers 20 which are separated in the circumferential direction at regular intervals and each of which has a pair of circumferentially opposed walls 19*a*1, 19*a*2 are defined among the rotor 17, the housing member 19, the front plate 21 and the rear plate 22. On the outer circumferential portion of the rotor 17, six grooves 17*a* which are extended inwardly therefrom in the radial direction and which are separated in the circumferential direction at regular intervals are formed thereon. Six vanes 18 which are extended outwardly in the radial direction into the chambers 20 are mounted in the grooves 17*a*, respectively. Thereby, each of chambers 20 is divided into a first pressure chamber 30 and a second pressure chamber 31, both of which are separated in a fluid-tight manner from each other.

The rotor 17 is provided with six first passages 28 and six second passages 29. One end of each of the first passages 28 is communicated with the circular groove 13 and the other end of each of the first passages 28 is communicated with each of the first pressure chambers 30. On the other hand, one end of each of the second passages 29 is communicated with the circular groove 12 and the other end of each of the second passages 29 is communicated with each of the second pressure chambers 31. The circular groove 13 is in communication with a passage 27 which is formed in the exhaust cam shaft 2 at its axial center and which is extended in the axial direction via a passage 46. The circular groove 12 is in communication with a pair of passages 26 which are formed in the exhaust cam shaft 2 so as to locate on the coaxial circle about the axial center of the shaft 2 and which are extended in parallel in the axial direction via passages 45. Now, in this embodiment, the passage 27 is formed at the same time as the lubrication passage for the journal portions (not shown) which are located at the right side of the exhaust cam shaft 2 in FIG. 1. The passage 27 is separated from the lubrication passage by a ball 35 which is pressed into the lubrication passage and is separated from outside by a ball 34 which is pressed into the passage 27. On the other hand, the passages 26 are symmetrical about the passage 27 and have the same flow resistance as that of the passage 27. Therefore, the passages 26, 27 which have a predetermined flow resistance can be obtained by machining without increasing the diameter of the cam shaft 2.

A portion of the exhaust cam shaft which is located between the cylindrical portion 10 and the projecting end portion of the exhaust cam shaft 2 is rotatably supported on the cylinder head 1 and a cover (not shown) and is provided with a circular groove 43. The circular groove 43 is in communication with the passages 26. The supporting surfaces of the cylinder head 1 and the cover (not shown) for supporting the exhaust cam shaft 2 is provided with a circular groove 44. The circular groove 44 is in communication with the passage 27 via a passage 47.

A fluid supplying device 38 is comprised of a changeover valve 39, a fluid pump 40 and a controller 41. In this embodiment, the changeover valve 39 is an electromagnetic valve which is of the four port—three position type. The fluid pump 40 is driven by the engine and discharges the fluid (oil) for lubricating the engine. The pump 40 may be a pump for lubricating the engine. The circular groove 44 is in communication with a port A of the changeover valve 39 and the circular groove 43 is in communication with a port B of the changeover valve 39. A port P of the changeover valve 39 is in communication to a discharge portion the fluid pump 40 and a port R of the changeover valve 39 is in communication to a reservoir 42. The position of the changeover valve 39 is controlled by the controller 41 so that a first condition in which the discharged fluid from the pump 40 is supplied to the circular groove 44, and in which the circular groove 43 is in communication with the reservoir 42, a second condition in which the communication between the circular grooves 43, 44 and the pump 40 and the reservoir 42 are interrupted, respectively and in which the discharged fluid from the pump 40 is supplied to the reservoir 42 and a third condition in which the discharged fluid from the pump 40 is supplied to the circular groove 43 and in which the circular groove 44 is in communication with the reservoir 42 are selectively obtained. The controller 41 controls the above conditions of the changeover valve 39 based on parameter signals which are engine speed, the amount of opening of a throttle valve (not shown) and so on.

As shown in FIG. 2 and FIG. 3, a fluid receiving portion la, which is a concave portion for reserving the fluid, is formed on the cylinder head 1. The fluid receiving portion 1*a*allows the fluid for lubricating the journal portions of the exhaust cam shaft 2 and the intake cam shaft 3 to flow therein. In the fluid receiving portion la, a part of the valve timing control mechanism 16 is accommodated therein and is always immersed in the fluid. Now, in this embodiment, the level of the fluid in the fluid receiving portion la is determined to be positioned near the lowest portion of the rotor 17 as shown in FIG. 3.

The operation of the valve timing control device having the above structure will now be described.

With the starting of the engine, the exhaust cam shaft 2 is rotated clockwise by the timing pulley 7 as shown in FIG. 2. Thereby, the exhaust valves (not shown) are opened and closed. Simultaneously, the rotor 17 is rotated and gear 4 is then rotated via the vanes 18, the housing member 19 and the bolts 23. The rotation of the gear 4 is transmitted to the gear 5 and the intake cam shaft 3 is then rotated so that the intake valves (not shown) are opened and closed.

The gear 4 is rotatably mounted on the journal portion 14 of the exhaust cam shaft 2. Therefore, when the pressurized fluid is supplied from the pump 40 to the second pressure chambers 31 by the changeover valve 39 changed to the third condition via the circular groove 43, the passages 26 and 45, the circular groove 12 and the second passages 29, the housing member 19, the front plate 21 and the second plate 22 are rotated clockwise with the gear 4 relative to the exhaust cam shaft 2 as shown in FIG. 3 and the intake cam shaft 3 therefore is rotated. Thereby, the valve timing control mechanism 16 is in the position of the maximum advanced condition in which the vanes 18 are contacted with the walls 19*a*1 of the chambers 20 and in which the angular phase of the intake cam shaft 3 is advanced relative to that of the exhaust cam shaft 2 (crank shaft 48) by a maximum value θ as shown in FIG. 3. In this condition, when the pressurized fluid is supplied from the pump 40 to the first pressure chambers 30 by the changeover valve 39 changed to the first condition via the circular groove 44, the passages 47, 27 and 46, the circular groove 13 and the first passages 28, the housing member 19, the front plate 21 and the second plate 22 are rotated counterclockwise with the gear 4 relative to the exhaust cam shaft 2 as shown in FIG. 3. Thereby, the valve timing control mechanism 16 is in the position of the maximum retarded condition in which the vanes 18 are contacted with the walls 19*a*2 of the chambers 20 and in which the angular phase of the intake cam shaft 3 is retarded relative to that of the exhaust cam shaft 2 (crank shaft 48) by a maximum value θ from the above mentioned maximum advanced condition. Now, depending on the manner in which the control of the changeover valve 39 is executed, the vanes 18 can be stopped in any position (intermediate advanced position) between the maximum advanced position and the maximum retarded position. This requires that balance be achieved between the fluid pressure of the first pressure chambers 30 and the fluid pressure of the second pressure chambers 31 when the vanes 18 have achieved an arbitrary position. In this intermediate advanced position, the fluid is supplied to both of the first and second chambers 30, 31. The amount of the advance can therefore be set to any value between a zero level and a maximum level.

As mentioned above, the opening and closing timing of the intake valves (not shown) driven by the intake cam shaft 3 is adjusted, and the angular phase difference between the crank shaft 48 and the intake cam shaft 3 is adjusted.

Further, in this embodiment, since the only member which requires an axial length is the nut 25 except for the valve timing control mechanism 16, and therefore the valve timing control mechanism 16 is accommodated in the cylinder head 1 without increasing the size of the engine. The valve timing control mechanism is not projected outside of the engine (cylinder head) enabling the engine to be miniaturized. Thereby, the degree of freedom for disposing other devices is increased. Further, since the fluid which is leaked to outside of the chambers 20 is collected in the cylinder head 1, it is not necessary to strictly determine the fluid-tightness of the chambers and therefore additional seal members are not always required for sealing the chambers. Accordingly, the valve timing control device can be simplified.

In this embodiment, during the running of the engine, the fluid in the fluid receiving portion la is mixed by rotation of the valve timing control mechanism 16 and is used to lubricate the gears 4, 5 and so on. When the engine is stopped and supplying the fluid to the chambers 20 is stopped, even if the fluid in the chambers 20 leaks gradually via the contacting portions among the front plate 21, the rotor 17 and the housing member 19 and among the rear plate 22, the rotor 17 and the housing member 19, this leaked fluid is received in the fluid receiving portion la and the fluid remains in the chambers 20 which are located in the fluid received in the fluid receiving portion la. All of the fluid is not leaked from the chambers 20. Therefore, when the engine is started again under this condition or after the engine was stopped for a long time, it is prevented by the remained fluid that the vanes 18 impact on the walls 19*a*2 (19*a*1) in the chambers 20. Accordingly, noise generated by this impact is prevented.

Further, in this embodiment, the valve timing control mechanism 16 is fixedly nipped between the nut 25 and the journal portion 14 of the exhaust cam shaft 2. Therefore, the direction for mounting the valve timing control mechanism 16 onto the exhaust cam shaft 2 and the direction for screwing the nut 25 onto the exhaust cam shaft 2 are the same, and therefore the valve timing control mechanism 16 is easily fixed on the exhaust cam shaft 2. Accordingly, in the case that maintenance work on the valve timing control mechanism 16 is performed, it is easy to detach the valve timing control mechanism 16 from the exhaust cam shaft 2. Further, it is easy to mount the valve timing control mechanism 16 on the exhaust cam shaft 2 so as to be coaxial and the exact phase adjusting operation is secured.

As mentioned above, according to the present invention, since the valve timing control device is accommodated in the cylinder head, the valve timing control device is not projected outside of the engine (cylinder head), the engine is therefore miniaturized. Thereby, the degree of freedom for disposing other devices is increased. Further, since the fluid which is leaked to outside of the chambers is collected in the cylinder head, it is not necessary to strictly determine the fluid-tightness of the chambers and therefore additional seal members are not always required for sealing the chambers. Accordingly, the structure of the valve timing control device is simplified.

The principles, a preferred embodiment and modes of operation of the present invention have been described in the foregoing description. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A valve timing control device comprising:

a rotor fixed on a cam shaft rotatably supported on a cylinder head of an engine so as to be accommodated in the cylinder head;

a housing member rotatably mounted on the cam shaft so as to surround the rotor;

plural chambers defined between the housing member and the rotor, each of which having a pair of circumferentially opposed walls;

plural vanes provided with the rotor and extended outwardly therefrom in the radial direction into the chambers so as to divide each chamber into a first pressure chamber and a second pressure chamber; and a fluid supplying means for supplying fluid under pressure to at least a selected one of the first pressure chamber and the second pressure chamber, wherein the cam shaft is directly rotated by rotational torque from a crank shaft of the engine and the housing member is connected to another cam shaft via a rotational torque transmitting means, and a part of the housing member is accommodated in a fluid receiving portion which is formed on the cylinder head and in which the fluid can be reserved.

2. A valve timing control device according to claim 1, wherein the fluid supplying means includes a fluid pump from which fluid under pressure is supplied, an electromagnetic changeover valve connected to the fluid pump and alternately connected to a first passage means and a second passage means and a controller for controlling the control position of the changeover valve.

3. A valve timing control device according claim 1, wherein the housing member, the rotor and the vanes are united and this unit is fixedly attached between a journal portion of the cam shaft and a nut screwed onto the cam shaft.

4. A valve timing control device, comprising:

a cam shaft rotatably supported on a cylinder head of an engine, the cam shaft having a cylindrical portion;

a rotor mounted on the cylindrical portion of the cam shaft wherein the rotor does not rotate relative to the cam shaft and is accommodated in the cylinder head;

a housing member rotatably disposed on the rotor so as to surround the rotor;

a chamber defined between the housing member and the rotor and having a pair of circumferentially opposing walls;

a vane provided with the rotor and extending outwardly therefrom in a radial direction into the chamber so as to divide the chamber into a first pressure chamber and a second pressure chamber; and fluid supplying means for supplying fluid under pressure to at least a selected one of the first pressure chamber and the second pressure chamber, wherein the cam shaft includes a journal portion formed adjacent to the cylindrical portion, and the rotor, the housing and the vane together are fixedly attached between the journal portion of the cam shaft and a fixing member screwed onto the cylindrical portion of the cam shaft in an axial direction.

* * * * *